US005282370A

United States Patent [19]

Kiblawi et al.

[11] Patent Number: 5,282,370

[45] Date of Patent: Feb. 1, 1994

[54] AIR-CONDITIONING SYSTEM ACCUMULATOR AND METHOD OF MAKING SAME

[75] Inventors: Daniel F. Kiblawi, Rochester Hills; Dean M. Christie, Royal Oak; Todd R. Kelpin, Sterling Heights, all of Mich.

[73] Assignee: Fayette Tubular Technology Corporation, Wilmington, Del.

[21] Appl. No.: 879,808

[22] Filed: May 7, 1992

[51] Int. Cl.[5] ..... F25B 43/00

[52] U.S. Cl. ..... 62/503; 138/44

[58] Field of Search ..... 62/503, 83; 138/44

[56] References Cited

U.S. PATENT DOCUMENTS

| | | | |
|---|---|---|---|
| 3,765,192 | 10/1973 | Root | 62/503 X |
| 3,798,921 | 3/1974 | Scherer et al. | 62/217 |
| 3,919,859 | 11/1975 | Ross | 62/503 |
| 4,111,005 | 9/1978 | Livesay | 62/503 |
| 4,194,370 | 3/1980 | Morse | 62/503 |
| 4,291,548 | 9/1981 | Livesay | 62/503 |
| 4,354,362 | 10/1982 | Schumacher et al. | 62/503 X |
| 4,474,035 | 10/1984 | Amin et al. | 62/503 |
| 4,496,378 | 1/1985 | Kish | 55/316 |
| 4,653,282 | 3/1987 | Gueneau | 62/79 |
| 4,768,355 | 9/1988 | Breuhan et al. | 62/503 |
| 4,942,743 | 7/1990 | Gregory | 62/503 |
| 5,036,972 | 8/1991 | Cullen et al. | 206/204 |
| 5,052,193 | 10/1991 | Pettitt et al. | 62/503 |

*Primary Examiner*—William E. Tapolcai

*Attorney, Agent, or Firm*—Remy J. VanOphem

[57] ABSTRACT

An accumulator for use in an air-conditioning system wherein a refrigerant fluid is circulated. The accumulator embodies an enclosed housing defining an internal vapor chamber, an inlet tube, an outlet tube having a vapor inlet end in an upper portion of the vapor chamber, and a baffle member located within the housing between the upper and lower portions and within the vapor chamber to impede the flow of incoming partially vaporized fluid causing it to circulate within the chamber and allowing the refrigerant vapor to rise to the upper portion of the vapor chamber and to flow through the outlet tube. The baffle member is an integral part of the housing, being formed at the open end of one of two cup-shaped housing members and turning inwardly to provide a generally ring-shaped baffle member, with the cup-shaped members being joined at their open ends to complete the enclosed housing.

18 Claims, 4 Drawing Sheets

AIR-CONDITIONING SYSTEM ACCUMULATOR AND METHOD OF MAKING SAME

BACKGROUND OF THE INVENTION

1. Field of the Invention

The present invention relates to accumulator devices, particularly for vehicular air-conditioning systems, for separating moisture-laden, partially vaporized refrigerant fluid into a moisture-free refrigerant vapor having a predetermined, specific lubricating oil content.

2Description of the Prior Art

The use of accumulators in air-conditioning systems, particularly vehicular air-conditioning systems, is well known. One is placed downstream of the evaporator, which cools the passenger compartment air as it is passed over and through the evaporator, and therefore takes in partially or completely vaporized refrigerant fluid which may or may not have a relatively small amount of condensation created water, and which will also have a small amount of lubricating oil necessary to the functioning of the compressor. The partially vaporized refrigerant fluid, being on the downstream end of the evaporator, is at a relatively low pressure, in the order of 40 psig and a raised but relatively low temperature in the order of 60° F. (there being a modest temperature rise through the evaporator of about 10° F.). The accumulator is upstream of the condenser and its purpose is to assure that only refrigerant vapor passes to the compressor and that this vapor be moisture-free and include a prescribed amount of lubricating oil, and that the oil-laden vapor be free of particulates that might otherwise harm the compressor.

Thus the known accumulators basically accomplish five functions: (i) completely vaporize the refrigerant fluid, (ii) remove all water vapor, (iii) screen all particulates, (iv) inject into the outgoing vapor stream a predetermined amount of lubricating oil, and (v) act as a reservoir for the refrigerant when system demand is low. Typical examples of accumulators accomplishing these functions are shown in U.S. Pat. Nos. 3,798,921; 4,111,005; 4,291,548; 4,496,378 and 5,052,193.

The major challenges in designing such an accumulator are to provide one which is efficient, one which fits well within the system packaging—in other words, fits within the engine compartment and is easily accessible for maintenance—and one which is inexpensive to manufacture.

Of particular interest with regard to operation efficiency and manufacturing cost is the design and placement of the baffle within the interior of the accumulator which serves the purpose of separating pure vapor from liquified vapor, passing the former through the outlet and recirculating the latter until it completely vaporizes and it passes through the outlet. From the foregoing examples, those shown in U.S. Pat. Nos. 4,291,548 and 5,052,193 show a baffle which is a separate member or component designed to be placed within the system in some convenient manner, with the newer designs tending towards easily insertable, plastic, self-positioning self-positioning members.

It is a purpose of the present invention to improve upon these known designs and their method of manufacture.

SUMMARY OF THE INVENTION

The present invention contemplates an accumulator design for an air-conditioning system which is efficient in its operation, includes a minimum number of parts and is less expensive to manufacture relative to known commercial designs.

The invention further contemplates integrating the accumulator housing and baffle structure to thereby reduce the overall number of parts in the accumulator and facilitate its most efficient manufacturing and assembly.

The invention further contemplates an accumulator, as above described, wherein the incoming partially vaporized refrigerant is discharged through the inlet port below the integrated baffle whereby the refrigerant has the maximum amount of time in which to vaporize before it passes through the outlet port.

The invention further contemplates an accumulator, as above described, wherein all of the incoming, partially vaporized, moisture-laden refrigerant is caused to flow through the desiccant material provided for removing moisture from the refrigerant, and preferably forced to do so at the first point of entering the accumulator interior chamber.

The invention also contemplates an accumulator design, as above described, which readily facilitates, with no change in the interior structure and components, top-mounted inlet and outlet tubes and side-mounted inlet and outlet tubes or any combination of the above, thus facilitating the packaging of the accumulator within the engine compartment. These above objects, features and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
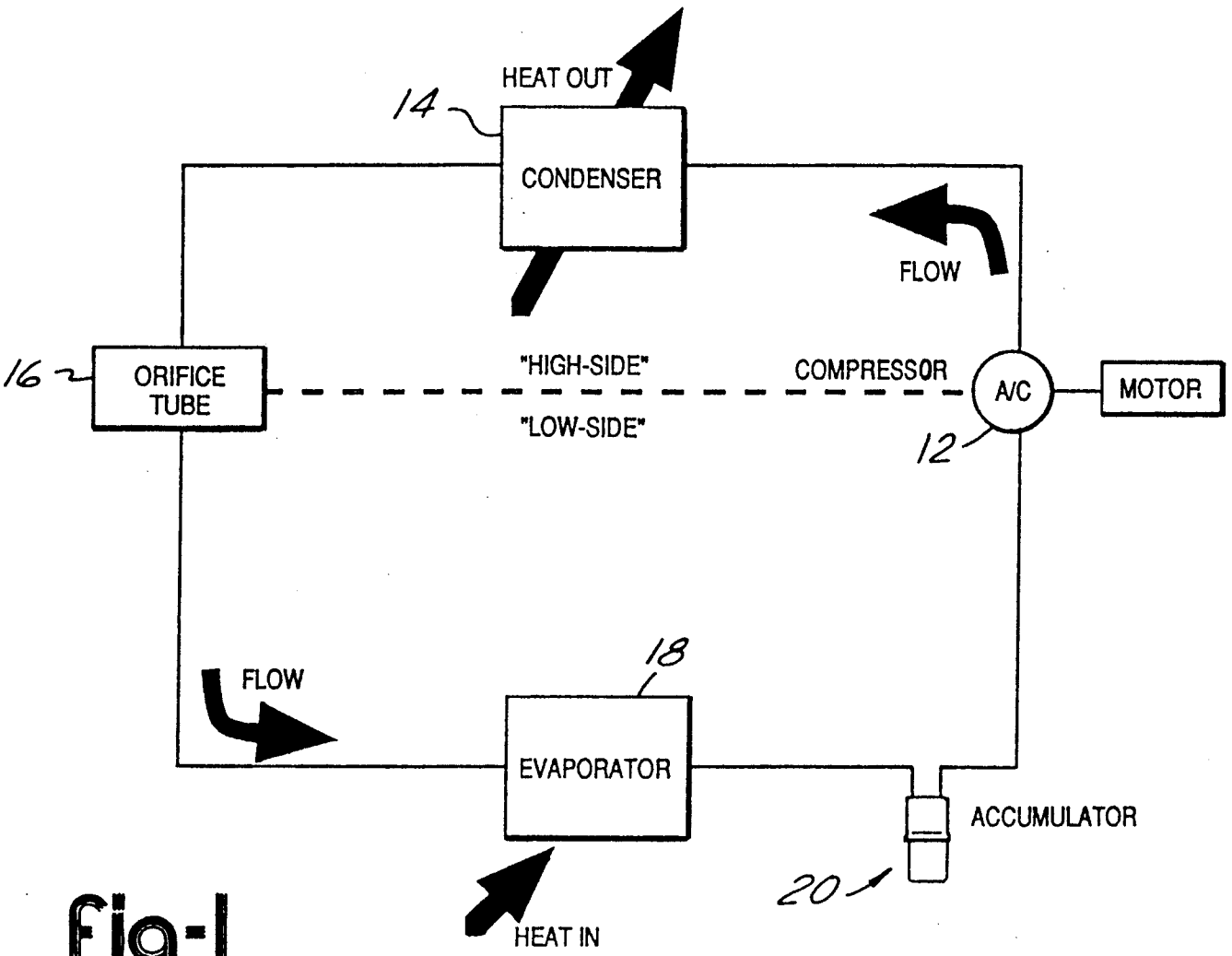
FIG. 1 is a schematic representation of a typical vehicular air-conditioning system incorporating use of an accumulator as may be designed pursuant to the present invention.

Referring to FIG. 1, there is a generally conventional vehicular air-conditioning system including a compressor 12, condenser 14, expansion device in the form of an orifice tube 16, evaporator 18 and an accumulator generally designated 20. A refrigerant fluid, such as Freon-12 or the like, is circulated through the system beginning as a high temperature/high vapor on the outboard side of the compressor, then passing through the condenser, during which time additional heat is taken out of the vapor forming a high temperature/high pressure liquid, then passing through the orifice tube, also commonly termed an "H" valve, causing thermal expansion of the refrigerant and thereby producing a low temperature/low pressure vapor/liquid stream passing through the evaporator which takes in heat from the heated vehicular passenger compartment and transforming the refrigerant to a low temperature/low pressure vapor. At this stage, the vapor temperature is generally in the order of 60° F. and at approximately 40 psig pressure.

Figure 2:
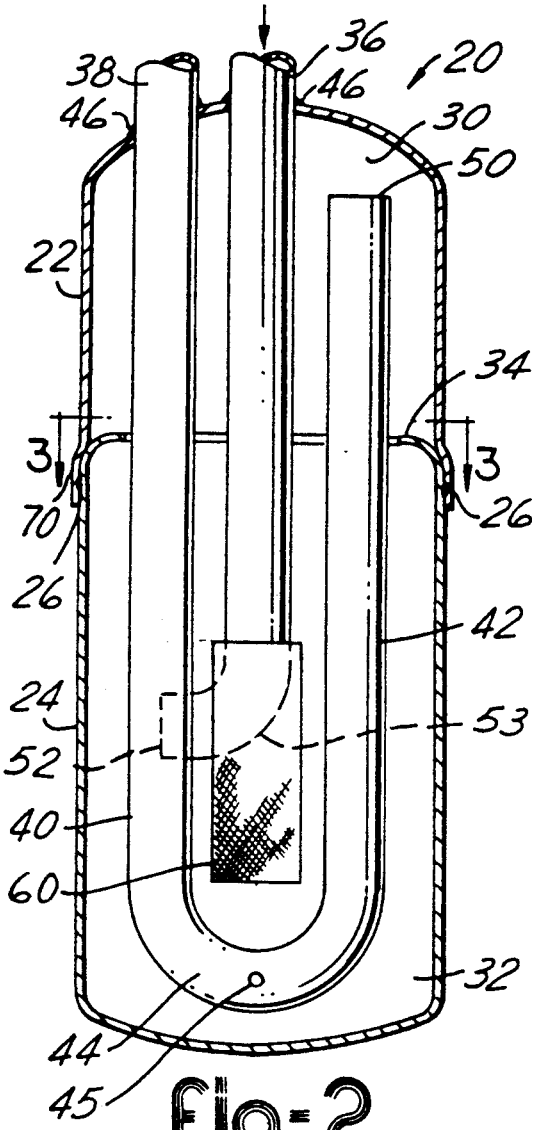
FIG. 2 is an elevational view shown partially in cross section of a first embodiment of the present invention.
Figure 3:
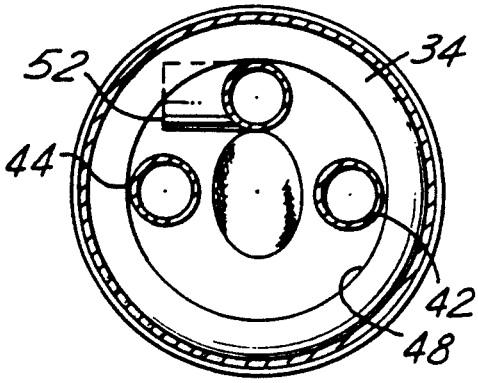
FIG. 3 is a plan view taken along section lines 3—3 of FIG. 2.

A first embodiment of an accumulator constructed in accordance with the present invention is shown in FIGS. 2 and 3 wherein the accumulator 20 has a housing composed of two cup-shaped shells 22 and 24, joined as by welding, brazing or soldering at their open end indicated at 26. The housing thereby defines an internal chamber having an upper portion 30 and a lower portion 32, generally coinciding to the boundaries of the respective cup-shaped members 22 and 24. The open, upper end of the housing member 24 is formed with a radially, inwardly directed flange or baffle member 34, which may be roll formed. As described in greater detail below, the flange 34 functions as a baffle member interrupting the flow of refrigerant vapor being received within the accumulator from the evaporator or inlet end of the accumulator.

The accumulator 20 further includes an inlet tube 36 and an outlet tube 38. The inlet tube is centrally disposed off-center as viewed in the plan view of FIG. 3, i.e., its axis is parallel but not coincident with the vertical axis of the accumulator. The outlet tube 38 is a generally U-shaped member embodying two vertically oriented legs 40 and 42, with a U-shaped bight portion 44 located at a predetermined distance from the bottom of the member 24. The bight portion includes a hole 45 for allowing lubricating oil, generally found in the incoming vapor stream and collecting at the bottom of the accumulator in a manner which is well-known, to be recirculated within the outgoing vapor stream.

The hole may be capped with an orifice filter (not shown) to act as a large particle trap and to precisely meter the amount of oil flowing downstream to the compressor.

Both the inlet tube 36 and the outlet tube 38 extend through holes drilled in the top closed end of the cup-shaped member 22 and are brazed or welded thereto as indicated at 46.

It will be noted that the inlet tube 36 and the legs 40 and 42 of the outlet tube will clear an inner annular edge or rim 48 of the flange or baffle member 34. The outlet tube 38 includes an inlet end 50 located at a predetermined distance from the top wall of the cup-shaped member 22.

The inlet tube 36 includes an unrestricted, open discharge end 52 located in the chamber lower portion 32 and below the baffle member 34, at the end of an angular elbow 53. As seen in FIG. 3, the discharge end 52 is directed generally tangential to the housing wall so that, at least initially, the discharged refrigerant will assume a circumferential flow path around the circumference of the housing. A desiccant material containing member 60 such as a cylindrically-shaped flexible bag member having tightly packed silica gel particles is disposed in the lower central region of the housing member 24 and may be fixed to one or the other of the inlet and outlet tubes 36 and 38 or both, or simply rest on the bight portion 44 of the outlet tube 38. Preferably, the baffle member 34, as viewed in FIG. 2, will be located within the middle one-third of the length of the accumulator, i.e. the length of the lower housing member 24 will be anywhere from one-half to twice the length of the upper housing member 22.

Also, regardless of the location of the baffle member 34 along the accumulator axis, the inlet tube's discharge end 52 is preferably located above the level of any refrigerant fluid collected within the housing member 24 when it functions as a lower reservoir for refrigerant fluid, i.e. when system demand is low or the system is inoperative.

In operation, the inlet tube 36 receives a low temperature, low pressure refrigerant mixture of liquid, vapor and oil as it has passed through the evaporator 18. The refrigerant mixture will exit from the discharge end 52 of the inlet tube 36 and flow partially upward under pressure and impinge upon the baffle member 34 which will re-direct the flow downward, thus interrupting any direct flow of liquid refrigerant into the outlet tube 38 and thereby ensuring sufficient vapor flow activity within the accumulator to cause the liquid/vapor mixture to completely vaporize prior to collecting at the top of the chamber, i.e. the upper portion 30 of the cup-shaped housing 22, at which point it is caused to flow through the inlet end 50 of the outlet tube 38.

All of the refrigerant mixture is caused to flow through or about the desiccant bag member 60 whereby any moisture content is removed. The desiccant material containing member may also function as a filter for particulates, as is well-known in the art.

A mixture of lubricating oil and liquid refrigerant will precipitate out of the moisture-free, particulate-free vapor or liquid/vapor mixture and collect at the bottom of the cup-shaped lower housing 24 to be adjusted at a controlled rate through the lubricating oil orifice or hole 45 of the outlet tube 38.

The method of manufacturing the above-described accumulator includes the step of forming, as by drawing, the cup-shaped members 22 and 24. The inlet and outlet ports in the upper cup-shaped member 22 are then formed by stamping to receive the pre-formed inlet and outlet tubes 36 and 38, and upon inserting the pre-formed inlet and outlet tubes in the cup-shaped member 22, each tube is brazed or welded to the top wall as indicated at 46 in FIG. 2. Further, the bottom cup-shaped member 24 is provided with the flange or baffle member 34 by roll forming, or any other suitable process, and the open end receiving portion of the upper cup-shaped member 22 is concentrically flared as by rolling or forming at 70, sufficiently to snugly receive the flanged end of lower cup-shaped member 24. Then the desiccant containing member 60 is positioned about the inlet and outlet tubes or secured thereto as previously described, and the cup-shaped members are axially slipped together in telescopic relationship until the flange 34 of the lower housing member 24 abuts against the internal shoulder formed at the flare 70. The two cup-shaped members are then welded around the entire circumference of the flare 70 as indicated at 26.

Regarding the geometry of the baffle member 34, it is believed the best results are obtained where its minor diameter to major diameter ratio ranges from about 0.5:1 to 0.95:1, and preferably where the ratio equals about 0.8:1. It is also preferred that the baffle member be convex with the convex surface presented towards the bottom portion 32 of the lower housing member 24. The degree of convexity will be such as to impart good circulatory action to the refrigerant mixture being circulated past the baffle member 34.

Figure 4:
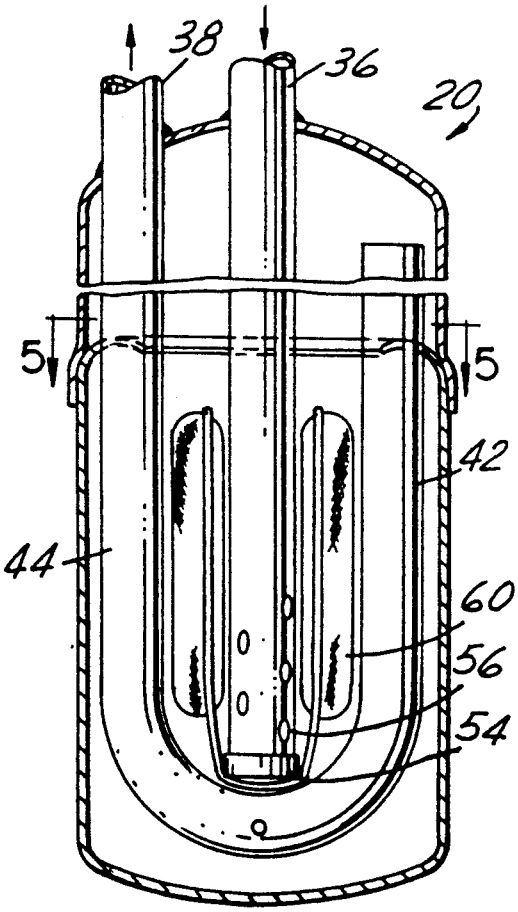
FIG. 4 is an elevational view shown partially in cross section of a second embodiment of the present invention.
Figure 5:
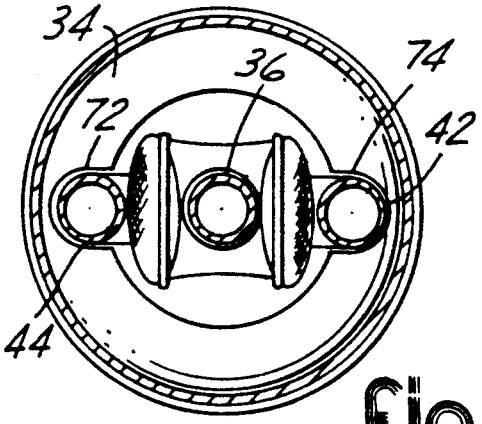
FIG. 5 is a plan view taken along section lines 5—5 of FIG. 4 of the second embodiment of the present invention.

In FIGS. 4 and 5 there is shown a second embodiment of the present invention. In this and other embodiments discussed below, like numerals are maintained where the elements are identical to those described in connection with the first embodiment of FIGS. 2 and 3. The primary difference in structure with that described in connection with the first embodiment is the structure of the baffle member 34. It will be noted from FIGS. 4 and 5 taht the outlet tube legs 40 and 42 are nearly adjacent the housing members 22 and 24 and to accommodate this, it is necessary to provide diametrically opposed cut-out portions 72 and 74 in the baffle member 34 as shown in FIG. 5, which receive and locate the outlet tube relative to the accumulator housing. Preferably these cut-out portions are stamped prior to the rolling of the flange or baffle member 34. Also, the inlet tube 36 is centrally disposed coincident to the vertical axis of the accumulator, is closed at the bottom by a cap member 54 and includes a plurality of passages or holes 56 to allow the incoming refrigerant mixture to pass through the desiccant material containing member 60 and then to the lower portion 32 of the chamber. A further difference lies in the desiccant material containing member 60 which is constructed as a saddlebag, as shown generally in U.S. Pat. No. 4,291,548, the description of which is incorporated herein by reference.

Figure 6:
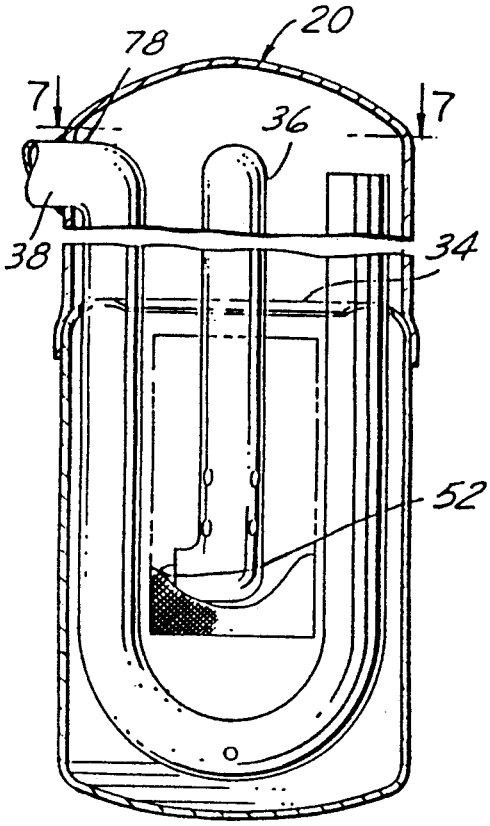
FIG. 6 is an elevational view shown partially in cross section of a third embodiment of the present invention.
Figure 7:
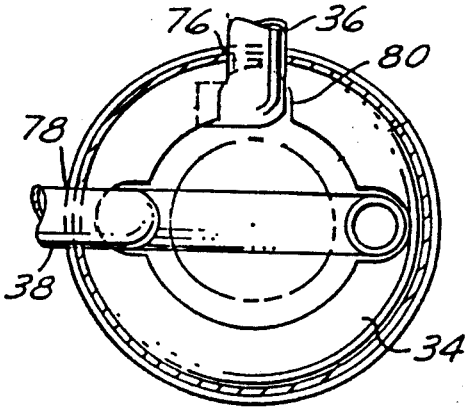
FIG. 7 is a plan view taken along section lines 7—7 of FIG. 6 of the third embodiment of the present invention.

A third embodiment is shown in FIGS. 6 and 7 wherein the inlet and outlet tubes 36 and 38 respectively, are "side-mounted", i.e., the inlet and outlet ports 76 amd 78 are located in the cylindrical side wall of the upper housing member 22. Further, it will be noted that the inlet tube 36 is located radially off-center of the axis of the accumulator and disposed near the wall of the housing as with the outlet tube 38. Because of this the baffle member 34 will include a respective cut-out and locating slot 80 similar to those described in connection with the embodiment of FIGS. 4 and 5.

It will be noted that the desiccant containing member 60 is cylindrical, as was shown in the first embodiment, and remains vertically disposed in the radial center of the accumulator, adjacent to the discharge end 52 of the inlet tube 36, as seen clearly in FIG. 7. Also, the discharge end 52 of the inlet tube 36 includes no outlet holes other than being completely open at its end 52 as shown, i.e. the cap 54 of the previously described embodiment is omitted and the open discharge end 52 is positioned adjacent the desiccant member 60 and directed to the side as with the first embodiment described.

Figure 8:
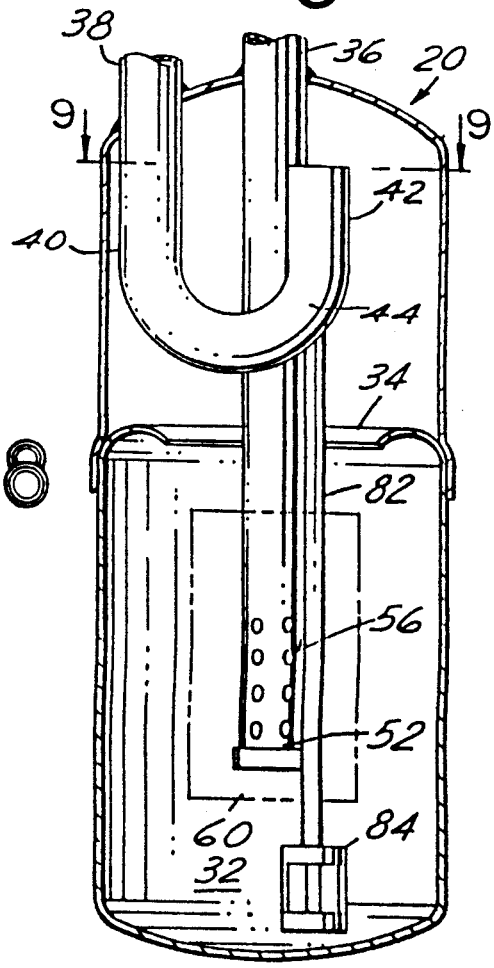
FIG. 8 is an elevational view shown partially in cross section of a fourth embodiment of the present invention.
Figure 9:
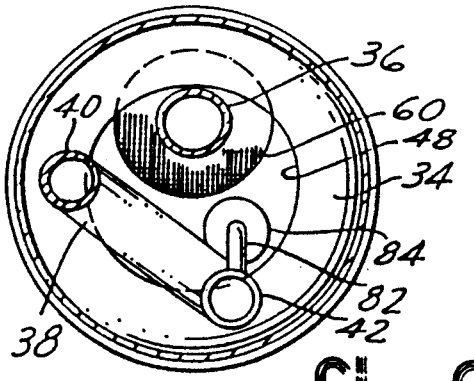
FIG. 9 is a plan view taken along section lines 9—9 of FIG. 8 of the fourth embodiment of the present invention.

Yet another embodiment of the present invention is shown in FIGS. 8 and 9. The primary difference in this embodiment with respect to those previously described is in the structure of the outlet tube 38, which it will be noted is relatively shorter in overall length than those previously described. In this embodiment, the bight portion 44 of the outlet tube 38 is located above the baffle member 34, and an oil pick-up tube 82 extends from the downstream end of the bight portion 44 to the bottom of the chamber. A screen member 84 is connected to the oil-pick up tube 82 and will filter any particulates which may be lying at the bottom of the accumulator. The rate of flow of lubricating oil is controlled by the diameter of the internal flow passage of the oil pick-up tube 82. This construction also makes possible the use of a cylindrical cartridge-type desiccant containing member 60. Its particular structure is not a part of the present invention, and any appropriate cartridge may be used, or in the alternative, a conventional saddle-bag type desiccant material containing member, as previously described, may be used. The inlet tube may be generally of the type as described in either FIGS. 2 or 4, with the latter alteration being shown. As seen in FIG. 9, the outlet tube may be disposed off-center of the accumulator access, such that the leg members 40 and 42 are located nearest the internal wall of the accumulator. The inner annular rim 48 of the baffle member 34 is uninterrupted as is the case in the embodiment shown in FIGS. 2 and 3.

Figure 10:
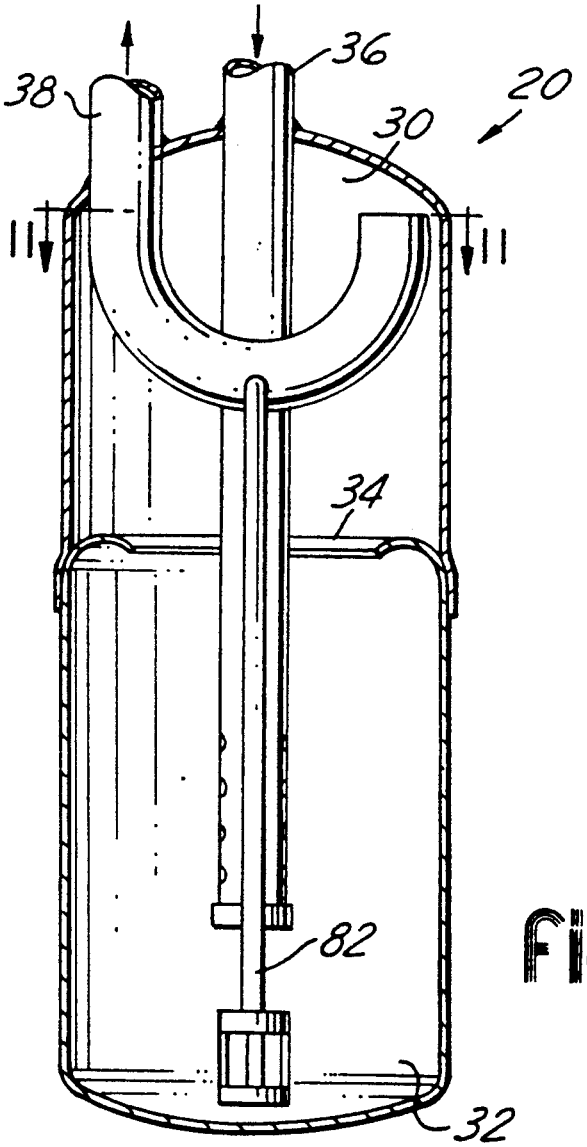
FIG. 10 is an elevational view shown partially in cross section of a fifth embodiment of the present invention.
Figure 11:
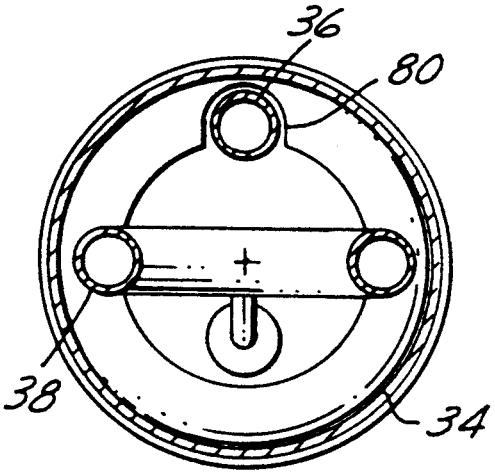
FIG. 11 is a plan view taken along section lines 11—11 of FIG. 10 of the fifth embodiment of the present invention.

Finally, in FIGS. 10 and 11 there is shown yet another embodiment of the present invention. Like the immediately preceding embodiment, the outlet tube 38 is disposed completely within the upper portion 30 of the chamber above the baffle member 34. In this case, the outlet tube 38 is centrally disposed, as seen in the plan view of FIG. 11, such that it passes through the vertical axis of the accumulator. As with the embodiment of FIGS. 8 and 9, the outlet tube 38 is connected to the elongated oil pick-up tube 82, extending to the bottom of the lower portion 32 of the chamber. The primary difference between this embodiment and that of FIGS. 8 and 9 is the location of the inlet tube 36 which is located off-center as with the embodiments of FIGS. 6 through 9, such that the baffle member 34 must include the cut-out and locating portion 80. The desiccant material containing member 60 used with this embodiment will be similar to that shown in connection with the embodiment of FIGS. 6 and 7, or in light of the lower chamber portion 32 being entirely free of the inlet tube and oil pick-up tube, a cartridge unit such as described in connection with the embodiment immediately preceding, may be utilized.

However, as with each embodiment other than that of FIGS. 2 and 3, the baffle member 34 turns down at the annular rim or edge 48 toward the lower portion 32 of the lower cup-shaped housing 24. In FIG. 2, it is to be noted the flange 34 is not so completely developed such that the inner annular rim 48 projects radially inward approximately perpendicular to the vertical axis of the accumulator. This difference in the degree the flange is turned is not believed to materially affect the refrigerant mixture circulation, but rather accommodates the circulation; but rather accommodates the fabrication of the unit.

Although particular embodiments of the present invention have been illustrated in the accompanying drawings and described in the foregoing detailed description, it is to be understood that the present invention is not to be limited to just the embodiments disclosed. Numerous rearrangements, modifications and substitutions are possible, without departing from the scope of the claims hereafter.

We claim:

1. An accumulator for use in an air-conditioning system wherein a partially vaporized refrigerant is circulated, said accumulator comprising:

a housing defining an internal chamber, said housing comprising a first upper portion and a second lower portion, said second lower portion of said housing having a closed end and an open end, said open end of said second lower portion of said housing having an inwardly extending annular flange defining an opening, said inwardly extending annular flange being a baffle member to impede the flow of said partially vaporized refrigerant, such that said baffle member causes said partially vaporized refrigerant to circulate within said second lower portion of said housing such that completely vaporized refrigerant is allowed to flow past said baffle member into said first upper portion of said housing;

an inlet tube passing through said first upper portion and into said second lower portion of said housing; and an outlet tube passing through said housing, said outlet tube having a refrigerant inlet port terminating in said first upper portion of said housing;

whereby said baffle member located within said internal chamber of said housing impedes the flow of incoming partially vaporized refrigerant causing it to circulate within said internal chamber until said partially vaporized refrigerant completely vaporizes such that the completely vaporized refrigerant flows past said baffle member and into said first upper portion of said internal chamber and further flows into said outlet tube.

2. The accumulator of claim 1, wherein said inwardly extending annular flange is an integral part of said housing and lies within a middle one-third of said housing.

3. The accumulator of claim 1, wherein said inlet tube further comprises an outlet port located in said second lower portion of said housing, said first upper portion of said housing defining said first upper portion of said internal chamber.

4. The accumulator of claim 1, wherein said outlet tube is a U-shaped tube having a bight portion therein, said bight portion of said outlet tube being located within said second lower portion of said housing and positioned a predetermined distance from said closed end of said second lower portion of said housing; and said bight portion having an oil pick-up orifice located therein to draw within a vapor stream being discharged from said accumulator a predetermined amount of lubricating oil collecting at said second lower portion of said internal chamber.

5. The accumulator of claim 4 wherein:

said housing is a cylinder having a closed top end and a closed bottom end, said closed top end defining a top wall, said closed bottom end defining a bottom wall; and said inlet and outlet tubes extend through said top wall.

6. The system of claim 4 wherein said housing is a cylinder closed at both ends to define a top wall and a bottom wall; and said inlet and outlet tubes extend through the cylindrical side wall of said housing.

7. The system of claim 1 further comprising:

a desiccant material containing member within said housing;

said desiccant material containing member being wrapped about the discharge end of said inlet tube, whereby all of the refrigerant fluid is caused to pass through said desiccant material containing member before being discharged to said vapor chamber.

8. The system of claim 7 wherein said inlet tube inlets a plurality of outlet passages at the discharge end, and said desiccant material containing member covers each of said outlet passages.

9. The accumulator of claim 1 wherein said first upper portion of said housing has an inlet aperture and an outlet aperture therein, said inlet tube passing through said inlet aperture and said outlet tube passing through said outlet aperture.

10. The accumulator of claim 9 wherein said first upper portion of said housing defines a first chamber region of said internal chamber, said second lower portion of said housing and said baffle member define a second chamber region of said internal chamber and wherein said outlet tube has a bight portion therein, said bight portion being located within said second chamber region of said internal chamber and positioned a predetermined distance from said closed end of said second lower portion of said housing.

11. The accumulator of claim 10 wherein said housing is a cylinder having a predetermined diameter, said inwardly extending annular flange defining a centrally located hole is a flat ring-shaped member having a major diameter and a minor diameter, said major diameter being substantially equal to said predetermined diameter of said housing and said minor diameter being between fifty and ninety-five percent that of said major diameter, whereby said inwardly extending annular flange presents a substantial impediment between said second lower portion of said internal chamber and said first upper portion of said internal chamber.

12. The accumulator of claim 9 further comprising a desiccant material containing member located within said housing.

13. The accumulator of claim 10 further comprising:

a desiccant material containing member located in said second lower portion of said internal chamber, and wherein said inlet tube has an outlet end located in said second lower portion of said housing and said desiccant material containing member is juxaposed said outlet end of said inlet tube.

14. The accumulator of claim 11 wherein said inlet tube has an outlet end pointing in a direction of a cord of a cross section of said cylindrical housing.

15. The accumulator of claim 11 wherein:

said housing is a cylinder having a predetermined diameter, a closed top end, and a closed bottom end, said closed top end defining a top wall, said closed bottom end defining a bottom wall; and said inwardly extending annular flange is located substantially within a middle one-third of said housing; said inwardly extending annular flange is a generally flat ring-shaped member having a major diameter and a minor diameter, said major diameter being substantially equal to said predetermined diameter of said housing at the location of said inwardly extending annular flange; said minor diameter ranging from about fifty percent to about ninety-five percent of said major diameter, whereby said baffle member presents a substantial impediment to a flow of refrigerant between said second lower portion of said internal chamber and said first upper portion of said internal chamber.

16. The accumulator of claim 15 wherein said baffle member has a concave surface in a cross section taken in a plane passing through an axis of said ring-shaped member, said concave surface being disposed toward said second lower portion of said internal chamber, whereby a partially vaporized refrigerant passing upwardly toward said baffle member is caused to circulate toward said second lower portion of said internal chamber.

17. The accumulator of claim 16 wherein said baffle member is an integral part of said housing and lies within a middle one-third of said housing as measured along a vertical axis of said accumulator.

18. The accumulator of claim 16 wherein said housing is formed of an upper cylindrical member and a lower cylindrical member; and wherein said baffle member is formed integrally with one of said upper and lower cylindrical members at one end thereof.

* * * * *

UNITED STATES PATENT AND TRADEMARK OFFICE

CERTIFICATE OF CORRECTION

PATENT NO. : 5,282,370
DATED : February 1, 1994
INVENTOR(S) : Kiblawi et al

It is certified that error appears in the above-indentified patent and that said Letters Patent is hereby corrected as shown below:

Column 5, line 23, delete "taht" insert --that --.

Signed and Sealed this

Tenth Day of January, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,282,370

DATED : February 1, 1994

INVENTOR(S) : Daniel F. Kiblawi, Dean M. Christie and Todd R. Kelpin

It is certified that error appears in the above-indentified patent and that said Letters Patent is hereby corrected as shown below:

Column 5, line 10, delete "convex" insert ---- concave ---- both occurrences.

Column 5, line 12, delete "convexity" insert ---- concavity ----.

Signed and Sealed this

Twenty-second Day of August, 1995

*Attest:*

Bruce Lehman

BRUCE LEHMAN

*Attesting Officer*

*Commissioner of Patents and Trademarks*